US009688457B1

(12) United States Patent
Healy

(10) Patent No.: US 9,688,457 B1
(45) Date of Patent: Jun. 27, 2017

(54) COOLING APPARATUS

(71) Applicant: Frank Healy, Phoenix, AZ (US)

(72) Inventor: Frank Healy, Phoenix, AZ (US)

( * ) Notice: Subject to any disclaimer, the term of this patent is extended or adjusted under 35 U.S.C. 154(b) by 0 days.

(21) Appl. No.: 14/963,454

(22) Filed: Dec. 9, 2015

(51) Int. Cl.
*B65D 30/00* (2006.01)
*B65D 81/38* (2006.01)
*B65D 33/16* (2006.01)

(52) U.S. Cl.
CPC ..... *B65D 81/3888* (2013.01); *B65D 33/165* (2013.01)

(58) Field of Classification Search
CPC .... F25D 3/08; F25D 31/007; F25D 2331/801; F25D 2331/8015; F25D 2331/803; B65D 81/3888; B65D 33/165
USPC ..... 383/4, 110, 901, 75, 38; 220/903
See application file for complete search history.

(56) References Cited

U.S. PATENT DOCUMENTS 103,842 A 6/1870 Campbell
119,453 A 10/1871 Davis et al.
309,233 A 12/1884 Luhmann
416,356 A 12/1889 Clark
1,594,248 A 7/1926 Efstathiou
1,606,538 A * 11/1926 Simeonoff ..... D05B 1/14 220/500
1,681,922 A * 8/1928 Boch ..... A45C 3/00 206/574
1,683,678 A * 9/1928 Kitterman ..... A45C 3/00 383/22
2,734,358 A 2/1956 Himmelfarb
3,059,452 A 10/1962 Griffin
4,134,276 A 1/1979 Lampard
4,195,491 A 4/1980 Roncaglione
4,468,933 A * 9/1984 Christopher ..... A45C 11/20 383/110
4,499,999 A * 2/1985 Behar ..... A45C 9/00 206/541
4,721,237 A 1/1988 Leslie
4,871,597 A * 10/1989 Hobson ..... B65D 81/3886 215/12.1
5,095,718 A 3/1992 Ormond et al.
5,201,194 A 4/1993 Flynn, Jr. et al.
5,520,014 A 5/1996 Laugier
5,653,337 A * 8/1997 Cirigliano ..... A45C 3/00 206/373
5,974,826 A * 11/1999 Baldwin ..... A45C 11/20 62/457.2
5,975,336 A * 11/1999 Hart ..... B65D 81/18 220/592.16
6,053,317 A * 4/2000 Morris ..... B65D 81/022 206/433
6,073,796 A * 6/2000 Mogil ..... A45F 3/16 215/12.1
6,422,032 B1 7/2002 Greene
(Continued)

*Primary Examiner* — Jes F Pascua
(74) *Attorney, Agent, or Firm* — Venjuris, P.C.

(57) ABSTRACT

The present invention enables hikers to easily carry both chilled water and chilled food items in a lightweight, compact package. A significant portion of the effort of carrying snacks on a hike comes from the weight of the food cooler and its chemical cooling elements. By placing the food items inside the body of a flexible cooler, then wrapping that cooler around a bottle of frozen water without covering the lid, the present invention lets the ice chill the food items while carrying them in a compact, lightweight container.

10 Claims, 5 Drawing Sheets

(56) References Cited

U.S. PATENT DOCUMENTS

| | | | | |
|---|---|---|---|---|
| 6,925,834 | B2 | 8/2005 | Fuchs | |
| 7,377,692 | B1 * | 5/2008 | Troncoso | A45C 11/20 150/154 |
| 7,597,209 | B2 * | 10/2009 | Rothschild | A45C 7/0036 220/23.87 |
| 7,810,348 | B2 | 10/2010 | Shewchuk | |
| 7,810,350 | B2 | 10/2010 | Shelton | |
| 7,845,508 | B2 * | 12/2010 | Rothschild | A45C 7/0036 190/107 |
| 8,714,389 | B2 * | 5/2014 | Rothschild | A45C 7/0036 190/1 |
| 8,757,427 | B2 * | 6/2014 | Hiner | B65D 23/104 215/12.1 |
| 8,857,210 | B1 * | 10/2014 | Dyke | F25D 3/08 62/457.1 |
| 9,126,748 | B2 * | 9/2015 | Hiner | B65D 23/104 |
| 9,193,516 | B2 * | 11/2015 | Hiner | B65D 23/104 |
| 2006/0242990 | A1 * | 11/2006 | Kao | F25D 3/08 62/457.4 |
| 2010/0139310 | A1 * | 6/2010 | Poterek | F25D 3/08 62/457.4 |
| 2010/0319382 | A1 * | 12/2010 | Burrini | A47G 9/0215 62/259.3 |
| 2011/0030415 | A1 | 2/2011 | Breyburg et al. | |
| 2012/0048890 | A1 | 3/2012 | Hsu | |

* cited by examiner

COOLING APPARATUS

BACKGROUND

Hikers and backpackers often want to bring cold drinks and food items along on their excursions. While many hikers have long since learned to chill or even freeze water bottles prior to a hike in order to enjoy ice-cold water as the hike progresses, traditional methods of carrying chilled food items tend to require bulky lunch coolers with separate chemical cooling packs. Even on a short expedition, carried weight is one of a hiker's most important considerations. The extra weight and space of a food cooler can discourage hikers from bringing a food item at all.

Therefore, an unaddressed need exists for a tool with which hikers can carry chilled food items and water without an overabundance of weight and bulk.

SUMMARY OF THE INVENTION

This invention relates generally to a cooling apparatus and specifically to a cooling apparatus that can house food items and a frozen water bottle.

The cooling apparatus reduces the problem of weight and bulk by placing food items in contact with a bottle of frozen water and insulating the combined package. Rather than merely collecting ambient heat and melting to be consumed, the cold water bottle is put to use chilling the food items. This eliminates the need for separate storage and for separate cooling packs to chill the food items. The hiker can instead carry the food items and water bottle in one convenient package. When the hiker has finished consuming the food items and water, there are no heavy cold packs to carry back to the trailhead. Only the lightweight, slim-bodied device remains, still serving to keep remaining water chilled.

The invention, as disclosed herein, is a portable cooling device. Hikers need a way to carry and chill both water and food that is not too heavy or too bulky to carry. The cooling apparatus of the present invention is formed of a plurality of flaps which can hold snacks of varying size in proximity to a frozen water bottle to keep them chilled without the need for a chemical cooling element.

In its preferred embodiment, the cooling device consists of two flaps joined to a base piece. Each flap serves as both an insulator and as a storage pouch. A user stores food items such as sandwiches inside one or more of the pouches, places a water bottle on the base piece, then folds up the pouches to wrap up the water bottle. When secured in place using a fastener such as a lanyard, the device will insulate the water bottle against ambient heat. The water bottle then serves as a cooling element for the stored food items. Preferably, the user will freeze the water in the bottle prior to use; the water bottle will most effectively chill the food items this way, while the device slows the rate at which environmental heat melts the ice. The device leaves the mouth of the bottle uncovered, allowing the user to drink the water as the ice melts without unsealing the device or exposing the food items.

In another embodiment, the device would consist of three flaps. These flaps would be slightly smaller than those on the two-flap embodiment; as a consequence, a similarly-sized cooling apparatus with three flaps would have a smaller capacity for food items in each flap. However, the greater number of flaps would allow for different food items to be stored without any chance that the food items intermingle, allowing one to carry diverse food items such as candy and energy bars without mixing them.

Further embodiments could use larger or small base pieces to accommodate water bottles with larger or smaller diameters. Yet further embodiments could use longer or shorter flaps to accommodate taller or shorter water bottles. The preferred embodiment is sized for use with wide-mouthed Nalgene-brand water bottles popular with hikers today.

Other features and advantages of the present invention will be apparent to one with skill in the art upon examination of the following drawings and detailed description. It is intended that all such additional features and advantages will be included within this description, be within the scope of the present invention, and be protected by the accompanying claims.

BRIEF DESCRIPTION OF THE DRAWINGS

The components of the drawings are not necessarily to scale, emphasis instead being placed upon illustrating the principles of the cooling apparatus. Like reference numerals designate corresponding parts throughout the several views.

DETAILED DESCRIPTION OF THE PREFERRED EMBODIMENT

Figure 1:
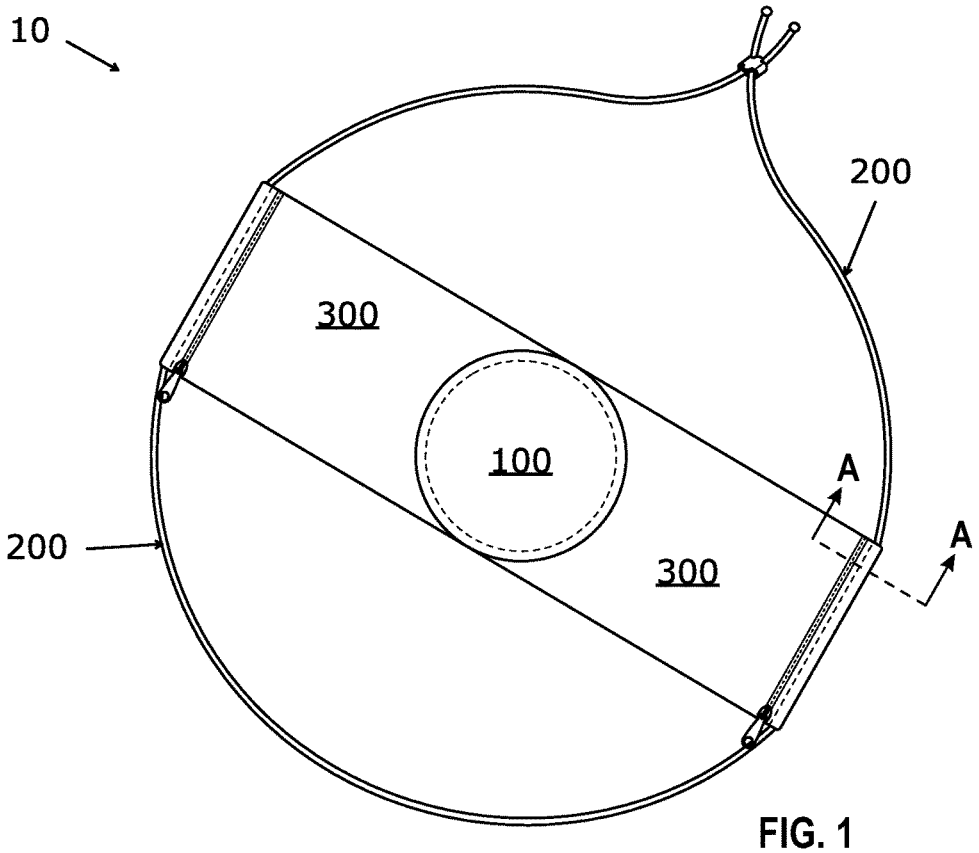
FIG. 1 is a top view of the cooling apparatus in its open configuration with the preferred lanyard fastener.
Figure 2:
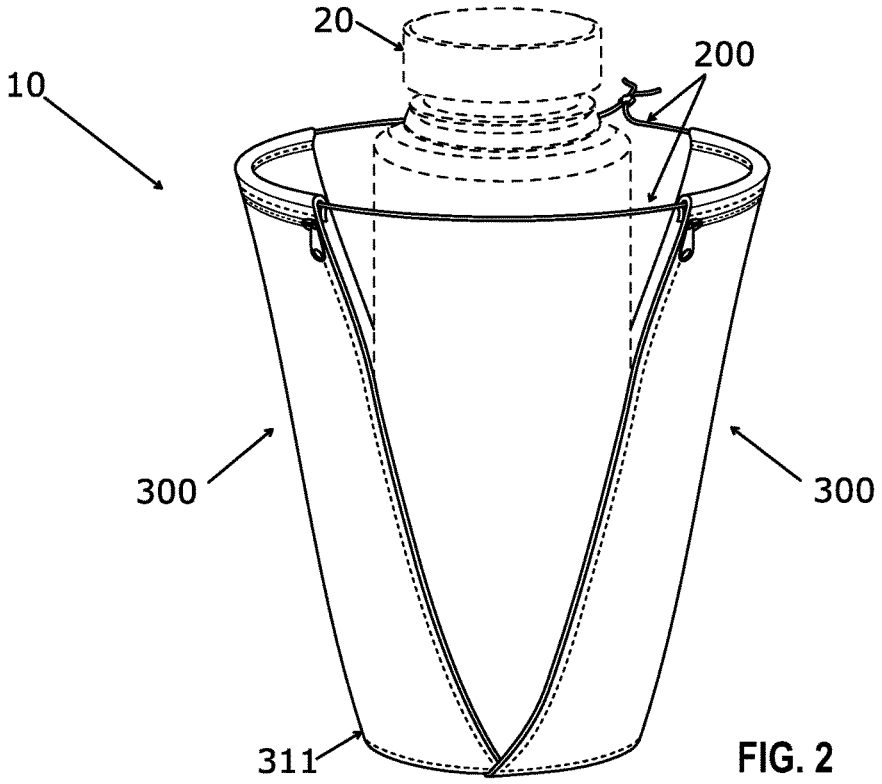
FIG. 2 is a side perspective view of the cooling apparatus of FIG. 1, partially closed around a water bottle.
Figure 3:
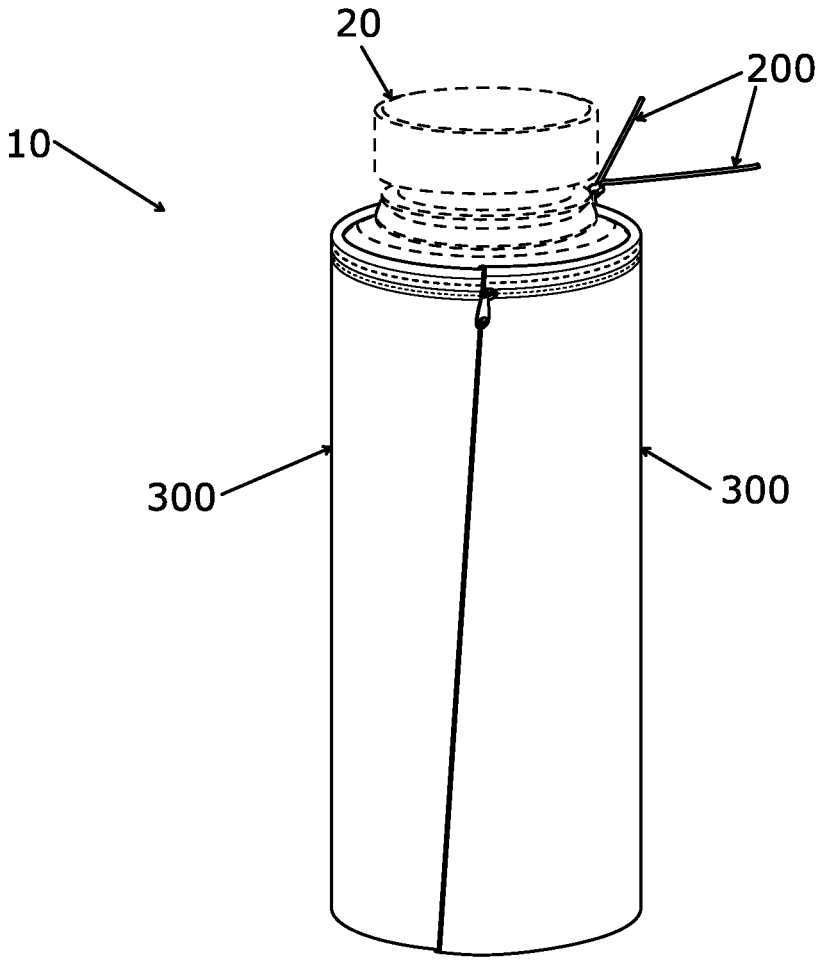
FIG. 3 is a side perspective view of the cooling apparatus of FIG. 1, fully closed around a water bottle.
Figure 4:
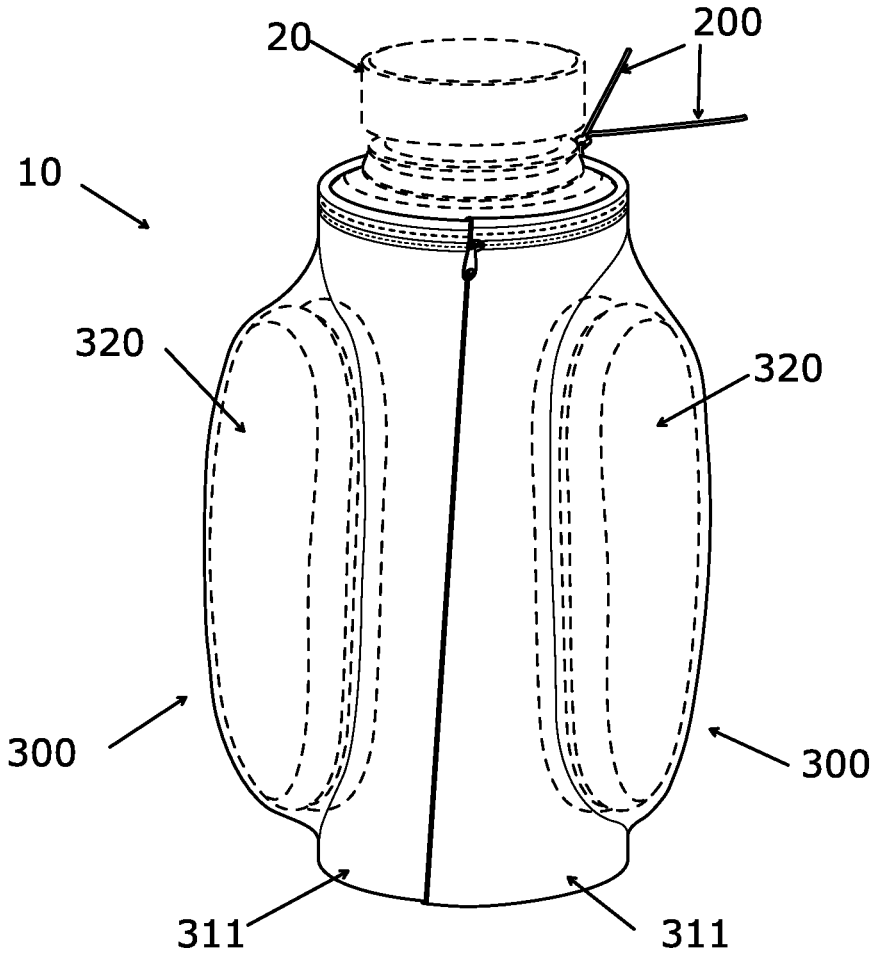
FIG. 4 is a side perspective view of the cooling apparatus of FIG. 1, fully closed around a water bottle and storing sandwiches in the side pouches.
Figure 5:
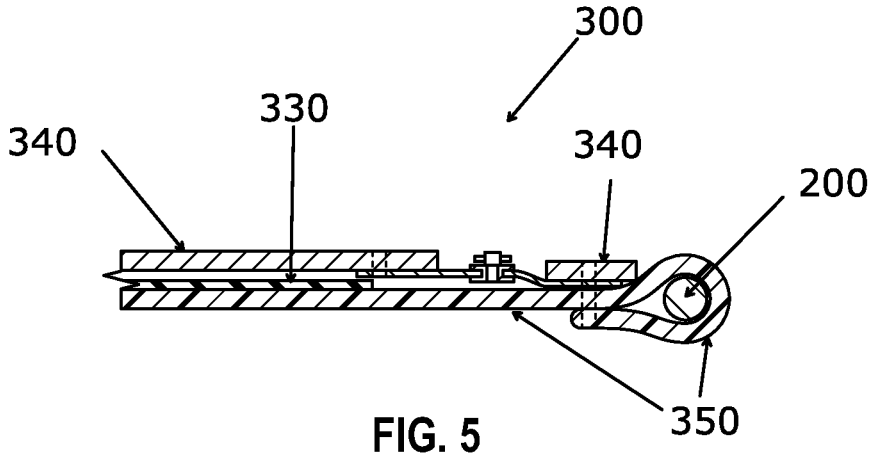
FIG. 5 is a cross-sectional view along a virtual line A-A of the cooling apparatus of FIG. 1.
Figure 6:
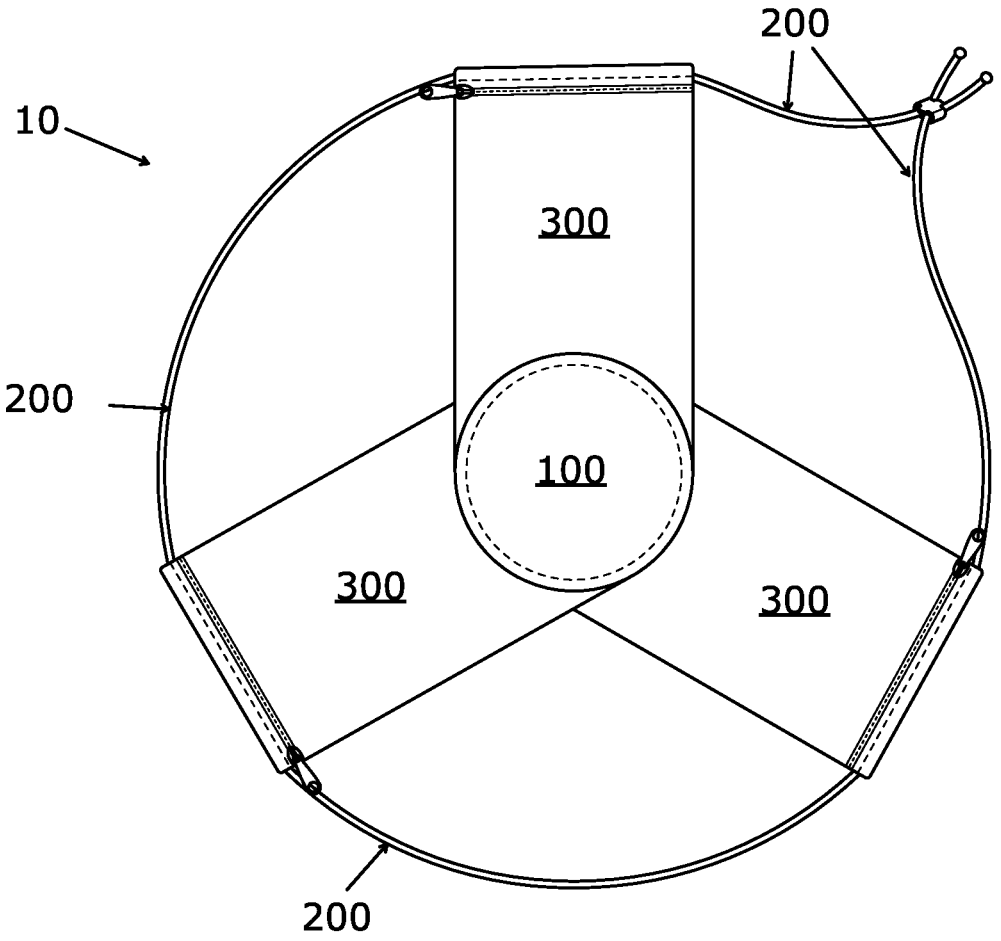
FIG. 6 is a top view of an embodiment of the cooling apparatus with three flaps in its open configuration.
Figure 7:
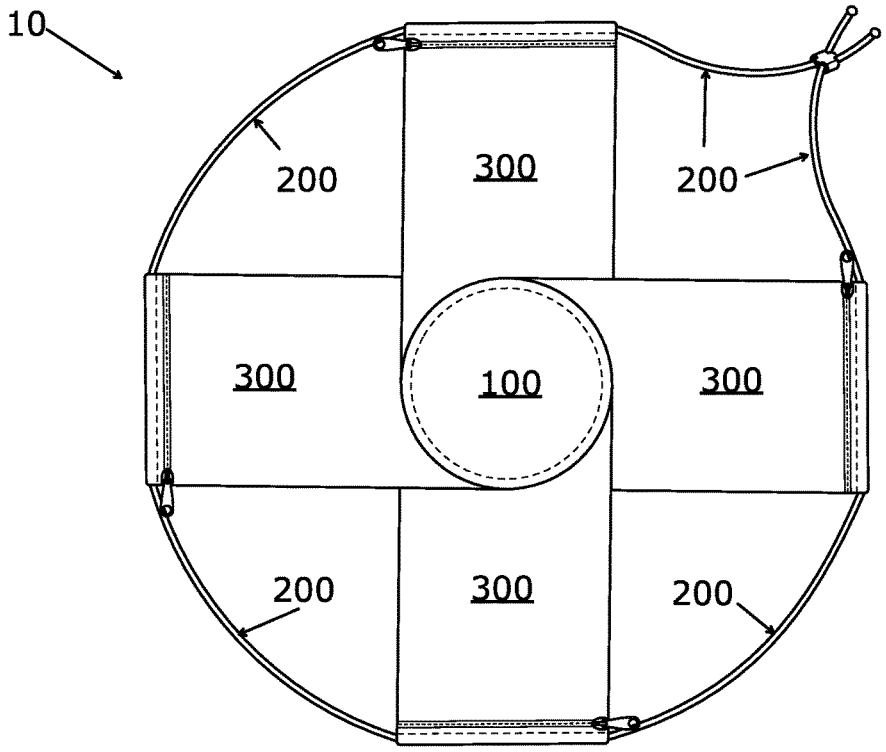
FIG. 7 is a top view of an embodiment of the cooling apparatus with four flaps in its open configuration.
Figure 8:
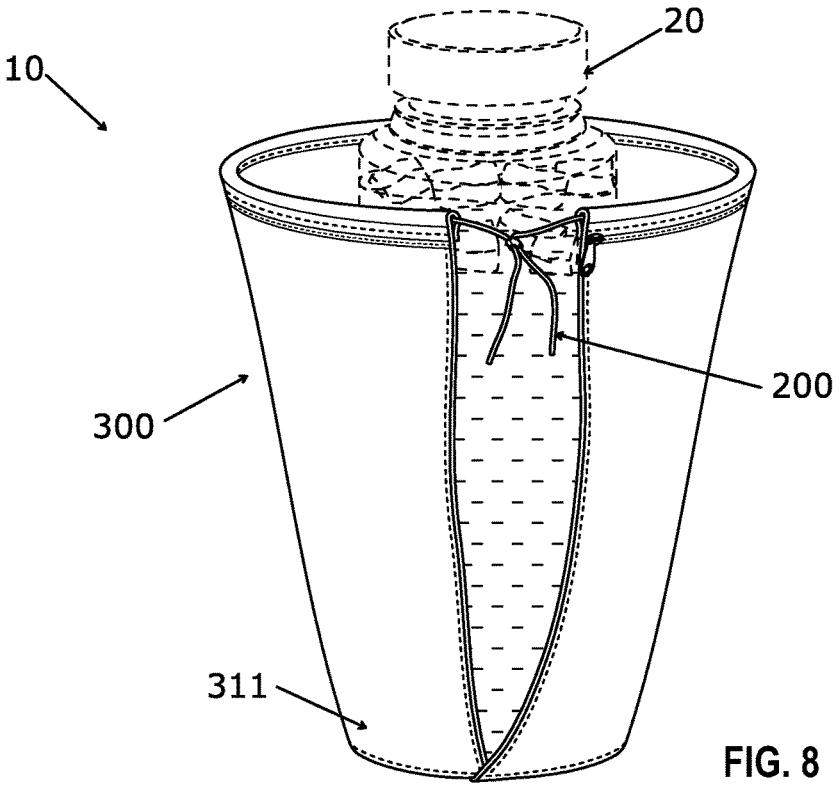
FIG. 8 is a side perspective view of an embodiment of the cooling apparatus with a single, tube-shaped flap.

The preferred embodiment of the cooling apparatus 10 comprises a base piece 100, to which at least two flaps 300 are flexibly attached. A first end 311 of each flap is attached to a base piece 100. When laid out flat, the flaps 300 spread around the base piece 100 in an "open" configuration. A water bottle, preferably with a diameter matching that of the base piece 100, is placed on top of said base piece 100. The flaps 300 can then be folded up against the sides of the water bottle and secured in place using a fastener 200 to form a "closed" configuration. In the preferred embodiment, said fastener 200 comprises a lanyard. In the closed configuration, only the top of the water bottle is exposed, allowing a user to open and drink from the water bottle without changing the cooling apparatus 10 to its open configuration. The inner sides of the flaps 300 and base piece 100 can comprise a water-resistant fabric or material 330 while the outer sides of the flaps 300 and base piece 100 can comprise a tougher, insulating fabric or material.

Each flap 300 also serves as a storage pouch for food items or other items to keep cool. In the preferred embodiment, each flap 300 further comprises a closure 320 comprising a zipper on the outer surface of said flap 300 which opens to allow access to a pouch between the layers 340 and 350 of the flap 300. This pouch is preferably waterproof to prevent its contents from leaking onto a user's hand. In the preferred embodiment, this pouch 300 is sized to contain a sandwich made from ordinary sliced bread, though storage of other food items is possible. When the cooling apparatus 10 is closed around a frozen water bottle 20, the food items will be chilled and the water will be insulated.

Alternate embodiments of the invention may make use of greater numbers of flaps 300 in order to hold more food items and provide increased insulation for the water bottle. Likewise, the flaps 300 may be made larger or smaller, either to accommodate different-sized water bottles or to accommodate a greater number of flaps than the preferred two.

Another alternative is a single flap embodiment. In the single flap embodiment, the flap is a tube enclosing (or connected to) the base piece 100. A water bottle, preferably frozen, is inserted into the open top of the tube and then cinched closed with a lanyard or similar closing mechanism known in the art. Sandwiches and other snacks can be place in the pouches for cooling and storage.

Other alternate embodiments of the invention could differ in how many layers of material the flaps 300 are composed of, what the materials are, or in how thick each layer is. More or thicker layers of material would tend to insulate the water bottle so it remains frozen and cold for longer, in turn keeping the food items cool for longer; however, these layers would also make the cooling apparatus 10 thicker and heavier. Such embodiments may be desirable in warmer hiking environments, but less desirable in cooler ones.

Further alternate embodiments of the invention may include different types of fastener 200 on the flaps 300. For instance, an embodiment may replace the distal-end lanyard with loop-and-hook fasteners along the long edges of the flaps 300, or metal or plastic button fasteners at the corners of the flaps 300. Another alternate embodiment may replace the preferred zipper closure 320 with a hook-and-loop closure 320.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the photos or herein are given as an example of possible components and not as a limitation.

The invention claimed is:

1. A method of carrying a food item and a bottle using a cooling apparatus, the method comprising the steps of:

placing one or more food items in storage pouches of a plurality of flaps of the cooling apparatus, wherein each flap comprises a first end, a second end with a fastener, at least two layers, and a storage pouch with a closure;

placing a bottle on top of a base piece of the cooling apparatus, wherein a perimeter edge of the base piece is attached to the first end of each flap;

folding the flaps perpendicular to the base piece; and operating the fastener of the second end of each flap to releasably secure the flaps upright against the bottle in a closed configuration of the cooling apparatus.

2. The method of claim 1, wherein the bottle comprises drinkable liquid and ice.

3. The method of claim 1, wherein the cooling apparatus comprises three or more flaps.

4. The method of claim 1, wherein the at least two layers of each flap comprises at least one outer layer and at least one water-resistant inner layer.

5. The method of claim 1, wherein the storage pouch is fitted into a space between the at least two layers.

6. The method of claim 5, wherein the storage pouch further comprises a water-resistant liner.

7. The method of claim 1, wherein the fastener comprises a lanyard movably attached to the second end of each flap.

8. The method of claim 1, wherein one long edge of a flap partially overlaps one long edge of another flap when both flaps are folded perpendicular to the base piece.

9. The method of claim 1, wherein the closure of the storage pouch is resealable.

10. The method of claim 1, wherein the closure of the storage pouch is exposed outward while in the close configuration.

* * * * *